United States Patent [19]

Oldengott

[11] 4,059,885

[45] Nov. 29, 1977

[54] PROCESS FOR PARTIAL RESTORATION OF A COKE OVEN BATTERY

[75] Inventor: Hans Oldengott, Bockum-Hovel, Germany

[73] Assignee: Dr. C. Otto & Comp. G.m.b.H., Bochum, Germany

[21] Appl. No.: 668,468

[22] Filed: Mar. 19, 1976

[30] Foreign Application Priority Data

May 19, 1975 Germany ..... 2512013
May 28, 1975 Germany ..... 2523640

[51] Int. Cl.[2] ..... B23P 7/00

[52] U.S. Cl. ..... 29/401 F; 29/401 E; 202/138; 202/139; 202/267 R; 110/1 A

[58] Field of Search ..... 29/401 F, 401 A, 401 D, 29/401 E, 401 R; 202/239, 267 R, 138, 139, 268, 270; 110/1 A; 432/3

[56] References Cited

U.S. PATENT DOCUMENTS

| | | | |
|---|---|---|---|
| 1,430,027 | 9/1922 | Plantinga | 202/267 |
| 1,760,770 | 5/1930 | Otto | 202/139 |
| 2,665,242 | 1/1954 | Otto | 202/268 |
| 2,705,414 | 4/1955 | Rose | 110/1 A |
| 3,102,846 | 9/1963 | Tucker, Jr. | 202/139 |
| 3,359,184 | 12/1967 | Thiersch et al. | 202/138 |

FOREIGN PATENT DOCUMENTS

| | | | |
|---|---|---|---|
| 677,638 | 4/1966 | Belgium | 29/401 |
| 282,882 | 3/1915 | Germany | 202/267 |
| 24,837 | 12/1901 | United Kingdom | 202/267 |
| 28,363 | 12/1902 | United Kingdom | 202/267 |
| 554,362 | 6/1943 | United Kingdom | 432/3 |

*Primary Examiner*—Victor A. DiPalma
*Assistant Examiner*—Daniel C. Crane
*Attorney, Agent, or Firm*—Thomas H. Murray

[57] ABSTRACT

A damaged part of a coke oven such as a heating wall is restored by selecting masonry bridging material with an essentially low thermal expansion property to close the heating flue and support the heating wall. The selected masonry bridging material may take the form of bridging bricks or castable concrete material. Such masonry bridging material is arranged to close and support the existing masonry which is to remain as part of the heating wall for continued use. The masonry bridging material forms flat connecting surfaces used to provide lateral expansion joints which are aligned from course-to-course. The expansion joint compensates for length changes of the renewed part of the heating wall formed by stretcher bricks having the usual relatively high thermal expansion property. The masonry bridging material reforms an internal crosswall that defines part of a heating flue chamber within a heating wall.

16 Claims, 7 Drawing Figures

PROCESS FOR PARTIAL RESTORATION OF A COKE OVEN BATTERY

BACKGROUND OF THE INVENTION

Figure 1:
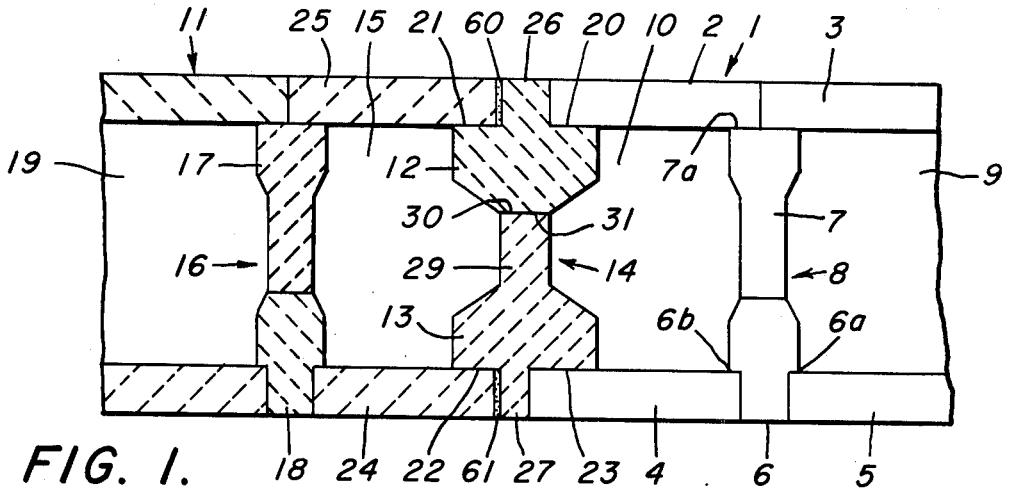

This invention relates to a process for restoring a damaged part of a battery of coke ovens such as a heating wall wherein masonry briding material is selected to provide a flat connecting surface and an expansion joint between the restored part of the masonary and the masonry briding material as well as the existing masonry to remain for continued use as part of the oven masonry. More particularly, the present invention relates to such a process for restoring a damaged part of a heating wall by an improved construction and an arrangement of brick-like or castable forms of bridging material to form a closure and support for existing masonry while at the same time providing low thermal expansion so as to compensate for thermal expansion of the renewed part of the heating wall and without developing undesirable forces on the existing masonry in the coke oven for continued use.

While not so limited, the present invention is primarily concerned with a process for the partial restoration of heating walls of a coke oven battery wherein a connecting surface is formed between the masonry to remain as part of the heating wall and the renewed portion of masonry for the heating wall. Such connecting surfaces are aligned to form a flat surface whereby under a load a lateral expansion joint is provided for the new construction of the heating wall between the flat surface and the replacement pieces of the heating wall. A horizontal expansion joint adjacent to the lateral expansion joint is incorporated between the new masonry and the continuous surface formed on the existing masonry.

The partial restoration of heating walls for coke oven batteries, especially such batteries having horizontal coking chambers, is a procedure designed to repair damage to brickwork arising from prolonged operation of the coke oven battery. To date, such damage could not be repaired and thus necessitated the shutting down of the coke oven battery for disassemblying and repairing the damaged portions thereof. Successful repairs of this type, on the other hand, will enable prolonged operation of the coke oven battery and thus maintain older coke oven batteries operational at a time when the need for coke is increasing. Moreover, this reduces the need for constructing new coke ovens to an absolute minimum.

As is known in the art, building bricks, having a relatively high expansion property, are used in coke oven construction for reasons of cost. The thermal expansion of common silicia brick is normally about 1.2% to 1.5% at operating temperatures prevailing in the coke ovens. The thermal expansion of the masonry is structurally compensated for and taken into account in various ways. The horizontal expansion is frequently accommodated by springs that are installed on the tie columns in the front of the heads of the heating walls. However, there are materials used to form building brick that exhibit little or no thermal expansion from ambient to normal operating temperatures of coke ovens. Nevertheless, these materials are generally too expensive for use to form conventional coke oven masonry.

Repair to the masonry of coke oven chambers having a relatively high thermal expansion property must, therefore, be carried out in such a way that the masonry remaining for continued use is maintained at a relatively high temperature of, for example, between 800° C and 1000° C, in order to avoid the contraction that would otherwise occur in the masonry upon substantial cooling. Moreover, substantial cooling of the masonry will, of itself, cause additional disintegration and destruction of the masonry. On the other hand, the replacement masonry used to form a restored part of the heating wall must be connected in a manner such that dimensional changes, particularly length changes that occur during subsequent heating, do not result in new damage. Expansion joints are generally provided to avoid such damage. These joints are formed, for example, from mortar that hardens only at the operating temperatures of the oven battery or from wooden inserts that burn out when the oven masonry is heated and thus provide the desired additional space to compensate for thermal expansion.

Finally, when undertaking repairs to a coke oven battery, one must take into consideration different types of damage which differ sharply from each other in their peculiarities. Damage to the heads of the coking chamber partition is, of course, the most frequent area of damage because the sharpest temperature drops and differences, e.g. stresses, during the coke pushing operation occurs at this site during the operation of the coking battery. However, sometimes the segment of the masonry between the heads is damaged. Should this occur, the entire chamber partition could then fall in on a segment between the oven heads. It is possible to detect damage at an early stage so that one wall of only one or more of the heating flues is damaged while the opposite wall of the heating chamber remains intact. Of course, it is then essential to remove, or break out, as little as possible of the undamaged masonry when undertaking repairwork.

In West German Patent Publication No. 2,122,729, there is disclosed a process for the partial restoration of heating walls for a horizontal oven chamber in a battery of coke ovens. This process permits the partial restoration of the entire chamber partition at the heads of the battery or on segments between the oven heads. In this process, after providing the necessary insulation for the working space and the subsequent dismantling of the damaged masonry, connector surfaces are prepared in the form of a continuous smooth surfaces. These surfaces are hewed out of the masonry which is still standing and part of the coke oven battery. Thus, the remaining masonry is used to form a lateral expansion joint while at the other side of the joint there is formed the segment of the masonry that is to be restored.

In this known restoration process, the hewing out of the connector surfaces to form a continuously smooth surface for an expansion joint is difficult work because it must be carried out on the remaining masonry at an elevated temperature. Consequently, there occurs new undesirable breakouts of the masonry and sharp cooling. This also produces cracks in the masonry and extensive leakage. In addition, it is not always possible to assure the stability of the remaining masonry at the site and thus, the replacement of masonry at the segment to be restored is sometimes inadequate.

SUMMARY OF THE INVENTION

It is an object of the present invention to provide an improved process for restoring a damaged part of a coke oven in a manner which will enhance the restoration process and, at the same time, better assure the successful restoration of the oven masonry.

It is a further object of the present invention to provide an improved process for restoring a damaged part of a battery of coke ovens wherein adequate support of the remaining masonry is achieved in order to establish sufficient stability before and after completion of restoration of a segment of the masonry while at the same time avoiding the need to prepare connecting surfaces for a continuously smooth surface at one or more lateral expansion joints on the existing hot masonry.

According to the present invention, the improved process is particularly characterized by closing and supporting the remaining existing masonry by using transition or bridging headers that exhibit little or no thermal expansion while at the same time providing the continuous smooth surface used to form a lateral expansion joint.

The use of such transition or bridging headers does, of course, slightly increase the costs for material; however, this is of little practical significance because of the relatively small number of bricks or other forms of bridging material employed for this purpose. The process does have the distinct advantage that it is no longer required to hew out connecting surfaces to form a continuous smooth surface that is otherwise necessary to provide a lateral expansion joint on the face of the remaining masonry. Thus, in the process of the present invention, all that is necessary is that the existing masonry be dismantled so that bridging headers can be mortared in. Since the bridging headers undergo little or no thermal expansion during their subsequent heating, they behave in the same manner as the hot bricks in the remaining masonry and thus the bridging headers can be fitted directly against the existing bricks. This behavior is true, not only in the vertical direction of restoration, but also for the horizontally-smooth areas of contact, whereby the bridging headers may be bricked in directly below a horizontal termination point, for example, at the roof of the oven.

The lateral expansion joint is preferably formed between the sides of the bricks or casting used to form bridging header and the masonry of the restored segment. By employing bridging bricks, the resulting support of the remaining masonry by these bricks substantially improves stability of the remaining wall section. The masonry of the restored segment of the wall can be bricked in with greater security and the repaired wall will acquire an improved strength.

The present invention offers the primary advantage that a gastight closure of the remaining wall and the masonry used to form the restored segment can be achieved. Since support for the remaining masonry is provided, a reinforcement of the chamber partition at the repair site occurs as a result thereof. This is naturally desirable because, among other things, it prevents the development of new damage. The restoration process itself can be carried out in a more simplified and rapid manner than was possible to date while permitting partial restoration by, for example, carrying out repair work for individual areas to a wall of one or more adjacent heating flues. The damaged site is thus strengthened by the insertion of the bridging bricks or casting of bridging material with an increased bearing surface.

It is preferred to use bridging bricks in the process of the present inventon with binder heads and broadened end surfaces in addition to their binder heads in all layers when providing a front closure to support the remaining masonry; furthermore, the connecting surfaces that form the continuous smooth surface are attached in the heating wall by an alternating arrangement of broad and narrow binder heads on bridging bricks which are then used alternately in superimposed courses of masonry.

While the process of the present invention is suitable for restoring oven heads or ports, it is also suitable for the elimination of damage to segments of the chamber partition between the oven heads when the entire chamber partition must be dismantled as a segment that is to be restored. On the other hand, if only the wall of one or more heating flues requires restoration, one can proceed in accordance with the invention by using bridging bricks without binder heads and with the broadened front surfaces for the lateral support of the remaining masonry. In a further embodiment of the process of the present invention, one can proceed with the restoration process by removing binder heads that are left in the remaining masonry and using bridging bricks with binder heads and broadened front surface in addition to bridging bricks without binder heads.

The process of the present invention also concerns the use of bridging bricks or cast sections of bridging members made from materials, as described before, that exhibit low or no thermal expansion. If the masonry to be repaired has a basic structure that consists of runners and headers, the bridging bricks according to the present invention is characterized, in addition to being different in composition than the oven brick themselves, by the fact that at least one of the front sides is broadened as compared with the normal header brick in the masonry to be restored. This broadening of the front side of the brick may be of such magnitude that it provides approximately twice the support surface.

According to another feature of the present invention, the headers with a broadened front side is developed along side a binder head; however, there is also contemplated a variation wherein both sides of a binder head have broadened front faces.

The process of the invention is conveniently carried out by employing a set of bridging bricks as described above. Such a set is characterized by bridging bricks with binder heads, the front sides of which are approximately twice as wide as the other bridging bricks in the set. The two types of bridging bricks forming the set are alternately bricked into the masonry layers and thus provide a smooth surface for the lateral expansion joint.

Figure 2:
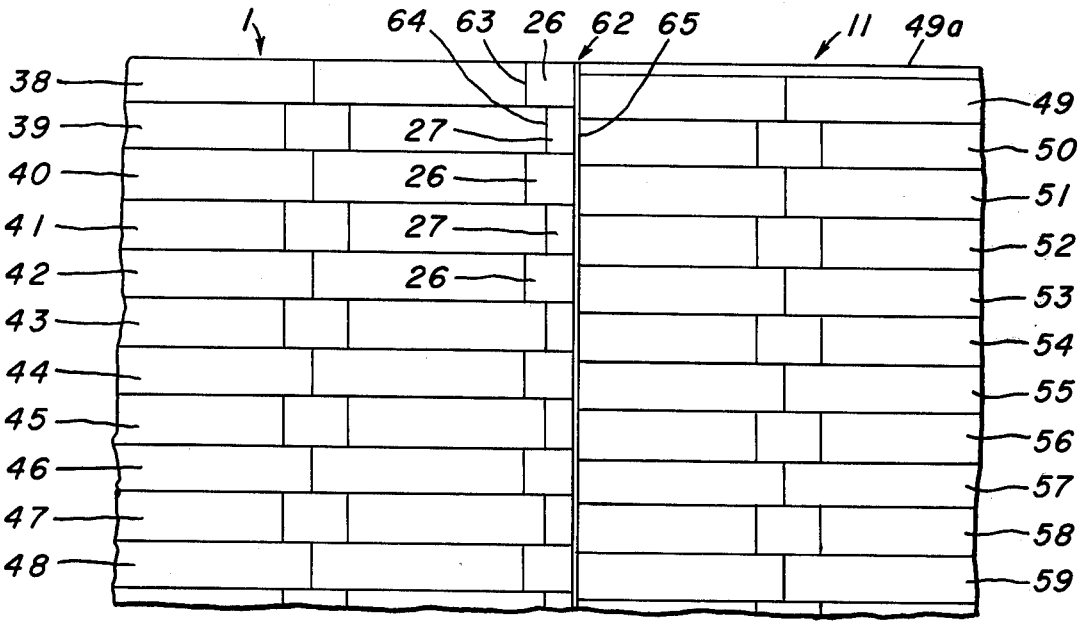
Figure 4:
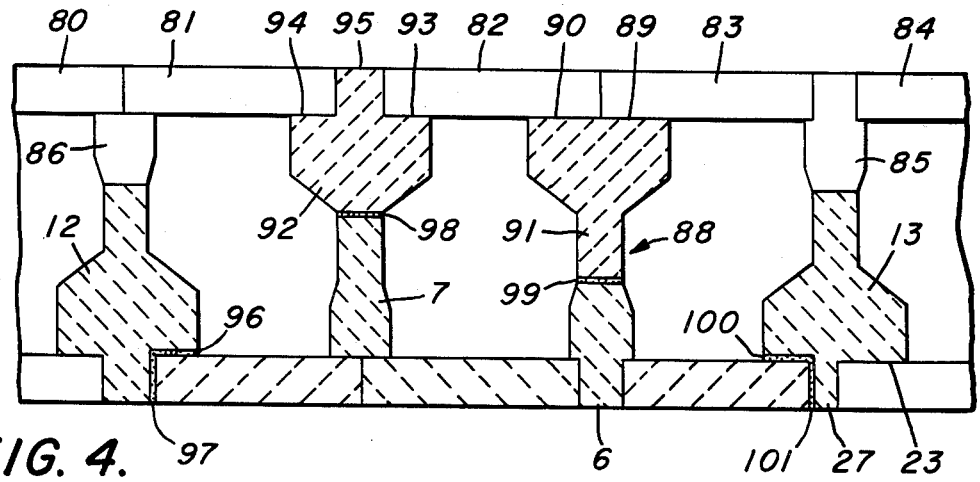
Figure 3:
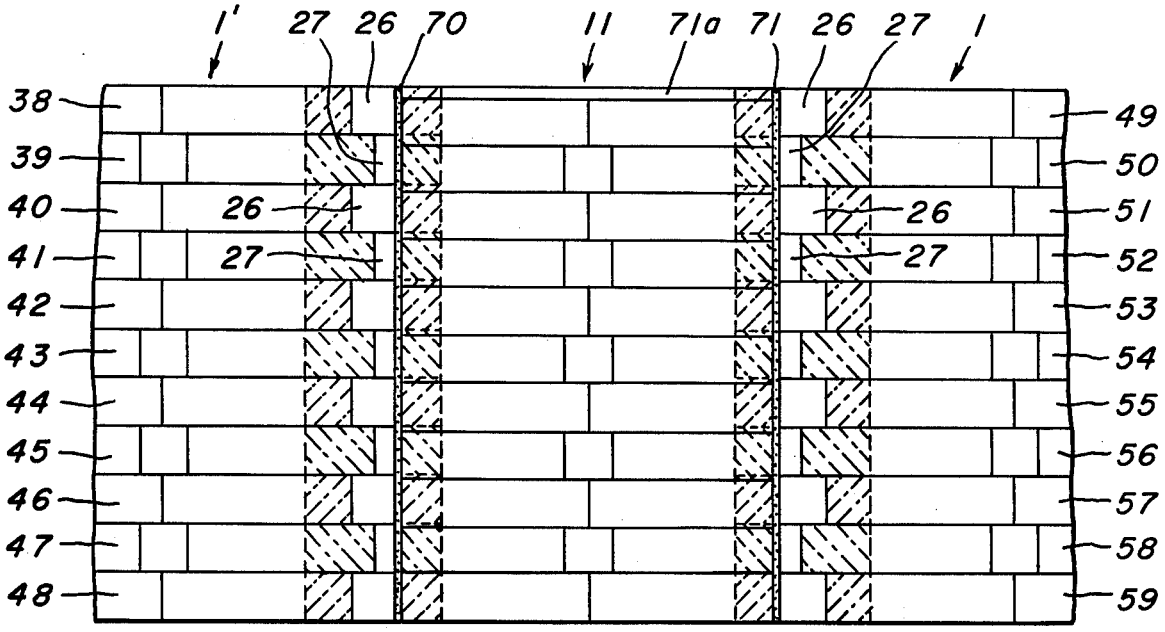
Figure 5:
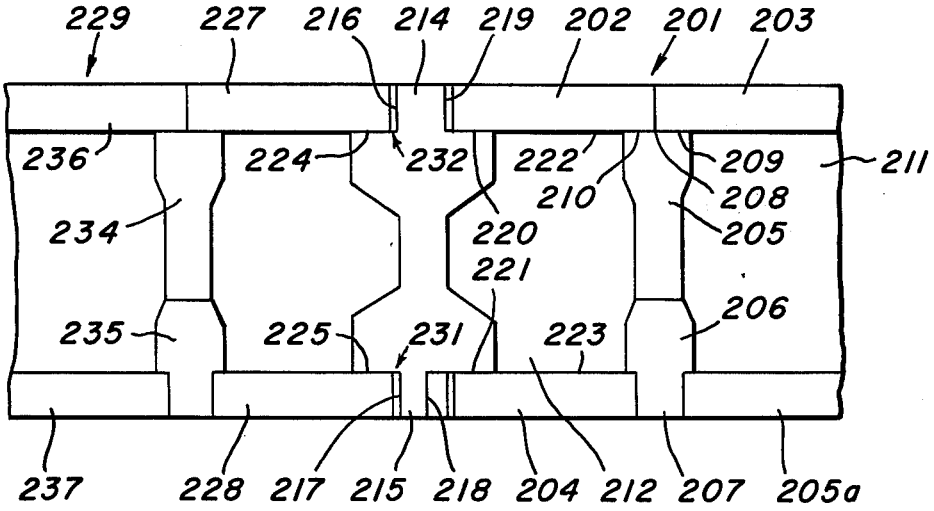
Figure 6:
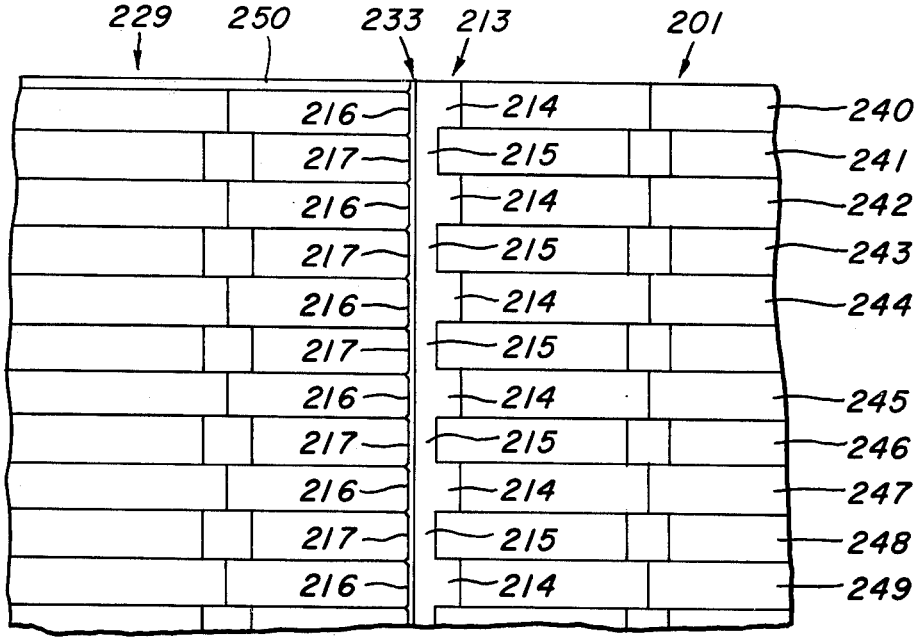
Figure 7:
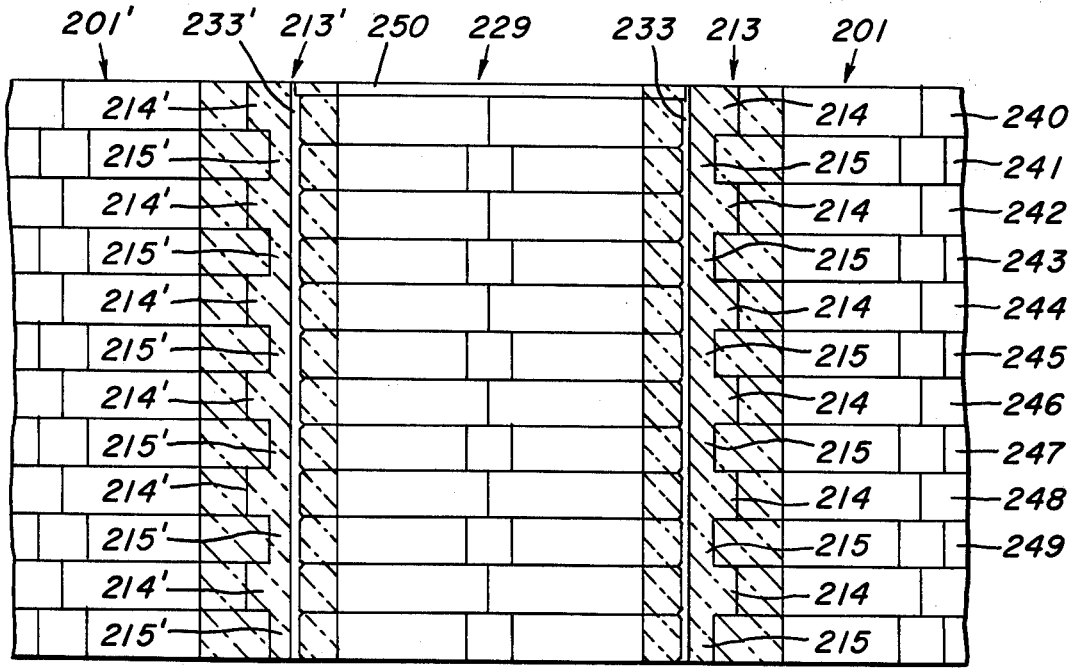

These features and advantages of the present invention as well as others will be more readily understood when the following description is read in light of the accompanying drawings of which:

FIG. 1 illustrates, in section, a top view of a heating wall after restoration of a portion thereof according to the process of the present invention, FIG. 2 is an elevational view of the restored heating wall shown in FIG. 1, FIG. 3 is a view similar to FIG. 2 in which the middle segment of the heating wall is renewed according to the process of the present invention, FIG. 4 is a view similar to FIG. 1 but illustrating the restoration of a small portion of a heating wall according to the process of the present invention, FIG. 5 is a top sectional view similar to FIGS. 1 and 4 but illustrating a further embodiment of the process of the present invention for restoring a section in a heating wall, FIG. 6 is an elevational view of the restored heating wall shown in FIG. 5, and FIG. 7 is a view similar to FIG. 6 but illustrating a restored heating wall according to a further embodiment of the restoration process according to the present invention.

In FIGS. 1 and 4, the hatching sections of masonry is intended to illustrate renewed portions of coke oven masonry as distinguished from and for the sake of better understanding unhatched portions of the masonry which is defined to mean existing masonry that will remain for continued use as part of the coke oven. As is shown in FIG. 1, the original masonry consists of adjacent runners 2 and 3 which form part of a heating wall at one side of a heating flue and at the other side thereof other runners 4 and 5 form part of a heating wall at the other side of the same heating flues. Headers 6 and 7 form chamber partitions and represent limiting walls of heating flues 9 and 10.

The masonry indicated by hatched lines is replacement masonry for damaged and disintegrated masonry. The replacement masonry is applied after appropriate insulation is provided for the working space in which case the unhatched masonry is maintained at an elevated temperature of, for example of the order of, 800° C to 1000° C in order to avoid contractions and resulting dimensional changes.

In the process of the present invention, an initial procedure for restoring the damaged part of heating wall involves using bridging bricks 12 and 13 to brick in existing masonry, to form a partition which is a front closure for a heating flue chamber. This is portrayed by forming joints 20 and 23 which correspond to the development of joints with unhatched (existing) masonry. The bridging bricks are headers and consist of material that exhibits little or no thermal expansion upon being heated up to normal operating temperatures of the coke oven chamber. It is an important feature of the present invention to use bridging bricks 12 and 13 that aremade from material that can be heated to an operating temperature without any essential dimensional changes. In the example shown in the drawings, the bridging bricks 12 and 13 seal off the front side of the original or existing masonry including the above-mentioned heating flue 10 which is thus separated in a gastight manner from the heating flue 15 located in the restored part of the oven masonry. After the front side closure of the original masonry is bricked in with the aid of bridging bricks 12 and 13, new masonry is installed of which only the adjacent heating flues 15 and 19 are illustrated in FIG. 1. The replacement masonry used for bricking in the space projected from the bridging bricks 12 and 13 is used to seal off the heating flues 15 and 19. This replacement masonry is made from material and corresponds to the design of the brick used to form the original masonry. In this regard, the runner bricks 24 and 25 correspond to the runner bricks 2 and 3 or 4 and 5 and the headers 17 and 18 correspond to the headers 7 and 6.

As is clearly apparent in FIG. 1, the heating flues 10 and 15 which are closed by bridging bricks 12 and 13 on the sides facing each other essentially define the same volume for a heating flue as the existing design of heating flue shown at 9 and 19. These existing heating flues are limited by the partitions 8 and 16. Such use of bridging brick 12 and 13 is an important part of the present invention because the repaired chamber partition can also be heated normally at the transition points.

The bridging bricks 12 and 13 are similar in that they have large surface supports 20 and 23 for connecting with runner bricks 2 and 4 on their ends facing the original masonry. In the front side closure of the chamber partition shown in FIG. 1, the bricks 12 and 13 are also provided with binder heads 26 and 27 whereby the broadened support surfaces 20 and 23 are situated on the front side of the bridging bricks 12 and 13 and lie at one side of the binder heads 26 and 27, respectively. The bridging brick 13 differs from the bridging brick 12 by the fact that the front face of bridging brick 13 is approximately half as wide as that of the corresponding front face in the brick 12 because of the differences in the binder heads 26 and 27.

In FIG. 2 there is illustrated a set of bridging bricks 12 and 13 used for providing a front closure to the original masonry generally designated by reference numeral 11. The bridging bricks 12 and 13 are alternately bricked into successive layers, i.e. courses of superimposed bricks, of the original masonry 11. The successive layers of original masonry are designated in FIG. 2 by reference numerals 38–48. The vertical surfaces 63 and 64 of the binder heads 26 and 27, respectively, are staggered at the original masonry 11 but the wall joint formed with surfaces 64 and 65 are opposite the connecting surfaces of the binder heads 26 and 27 so as to provide a continuous smooth surface used to provide and limit a lateral expansion joint 62 on one side. The continuous smooth surface is identified by reference numeral 65 in FIG. 2. It should be noted here that the shaped bridging bricks 12 and 13 are connected directly to the existing masonry for continued use of part of the heating wall at the upper closure of layer or course 38; thus, there is no horizontal expansion joint at this site running along the oven cover. As is shown in FIG. 2, replacement masonry 11 consists of courses or layers 49–59. The replacement courses of masonry connect to the front side closure after bricked in with the shaped bridging bricks 12 and 13, of the original masonry 1 with the formation of the expansion joint 62. An expansion joint 49A is located above the course 49 of replacement masonry.

As soon as the process for replacing the new masonry is completed and the insulation has been removed, the oven is again placed in operation for carrying out a coking process. The headers and runners of masonry 1 consist of the same material as used to form the bricks of the original masonry 11 and, therefore, undergo the usual expansion. These changes in the length of the bricks forming the headers and runners are absorbed in the lateral expansion joint 62 and in the horizontal expansion joint 49A without damage to the restored heating wall.

In FIG. 3 there is illustrated a modification of the restoration process to that already illustrated in FIG. 1 and in this regard corresponding components bear the same reference numerals. In FIG. 3, the restored segment 11 is a middle portion between two sections of original masonry of the opposing oven heads 1 and $1^1$. The front side closure of the layers of original masonry 1 and $1^1$, designated in FIG. 3 by reference numerals 38–48, correspond to the closure of the masonry 1 shown in FIGS. 1 and 2. In order to illustrate the broadened support surfaces which are formed by the bridging brick and are connected to the original masonry and/or $1^1$, the broadened support surfaces are designated by dot-dash hatching in FIG. 3. Thus, in FIG. 3, the dot-dash hatching illustrates the broadened support surfaces as well as the comparatively narrow support surfaces on the bridging bricks 12 or 13, each having its own individual hatching.

In order to accommodate thermal expansion of the restored masonry 11, two lateral expansion joints 70 and 71 are provided in contrast to the design shown in FIGS. 1 and 2 wherein a corresponding single expansion joint is illustrated. Just as the expansion joint 62 extends to the expansion joint 49A, the two lateral expansion joints 70 and 71 pass into the horizontal expansion joint 71A. In the further modified form of the present invention shown in FIG. 4, the wall of headers 80–84 facing the upper edge will be assumed to have remained essentially undamaged and, thus, do not require restoration. At the site designated by reference numeral 95, let it further be assumed that there is a broken head of a header which requires restoration. The broken head corresponds to the head illustrated on the header 85. On the other hand, the sections of the heating flues connected to the headers 85 and 86 and to the runner bricks 81–83 and the wall segment facing the lower edge of the drawing require dismantling. The dismantled section of masonry is illustrated in the hatching of masonry in FIG. 4. The repair work is commenced by first insulating the working space and then the damaged masonry to be restored is removed, if still present at the site. To carry out this work, the broken binder head located at site 95 between the runner bricks 81 and 82 is driven out of the site by a bar or the like. Bridging bricks 12 and 13 are then inserted to close the front sides of the original masonry shere, in the case of the modification according to FIG. 4 and differing from the other embodiments, the header 86 and 85 remain for continued use as part of the heating wall. In addition, the arrangement of the headers 12 and 13 matches the arrangement of the successive layers of masonry as shown in FIGS. 2 and 3. The original masonry is supported with the broadened support surfaces 23 which are present on one side extending along the narrow binder heads 27. The binder head 95 of bridging brick 92 is inserted in place of the binder head that was previously removed. Brick 92 differs from the bridging bricks 12 and 13 only by the fact that it does not have the narrow stem. Such a stem is identified by reference numeral 91 and is included as part of the brick 88. Removal of the narrow stem 91 is necessary only because of the design of header 7 of the original masonry. The bridging brick 88 is bricked into the runners 82 and 83 of the original masonry with its broadened connecting surfaces 89 and 90. This header has no head but does include the narrow stem 91 such that the normal header 6 can be used in the replacement masonry. The surfaces 100 and 101 of the bridging brick 13; the surfaces 96 and 97 of bridging brick 12; and surfaces 98 and 99 of the bridging bricks 92 and 88 forms the points of contact that together provide a continuous smooth surface for lateral expansion joints. These expansion joints are represented in FIG. 4 by reference numerals 96 and 97; 98 and 99; and 100 and 101, respectively.

In the example shown for restoring a damaged part of a heating wall by FIG. 1, the support of the original masonry is effected as well as retained in the repaired wall with the aid of the bridging bricks. Normal header brick have relatively small support surfaces 6A and 6B. On the other hand, the support surfaces 20 and 21 and/or 22 and 23 of the bridging bricks 12 and 13 are appreciably broadened. These broadened support surfaces are located on both sides of the heads 26 and 27 provided on the bridging brick 12 and 13. In addition, the surface 23 is further broadened at the expense of the width of the binder head 27 such that the header 13 has a narrow front side 22 on one side of its head 27 and a corresponding broader front side 23. If the head is removed from a header, as can be seen in the example of header 88, the two surfaces 22 and 23 are coplanar and thus a further broadened surface is provided by the absence of head 27. Such broadening to the faces of the bridging brick also occurs in the case of the front surface 7A of the header 7 which, together with the header 6, forms a partition between the successive heating flues in a conventional masonry construction.

According to a further embodiment of the present invention illustrated in FIG. 5, the remaining undamaged wall masonry which is maintained at an elevated temperature is denoted by reference numeral 201 in FIG. 5. The existing masonry consists of connecting runner bricks 202, 203 and 204, 205A and headers 205, 206. The headers 205, 206 are arranged such that the header 206 with a binder head 207 is alternately inserted between the runners 202 and 203 or 204 and 205A. The arrangement of the header 205 alternates in a corresponding manner from course-to-course; it has surfaces 209 and 210 on its face, generally denoted in FIG. 5 by reference numeral 208, for supporting the back sides of the runners 202 and 203.

The headers 205 and 206 form limits to the heating flues 211 and 212 which are openings formed by the masonry.

To prepare for the repair work, the headers 205 or 206 and/or segments of these bricks are removed at the free ends of the runners 202 and 204. A form, or casing is then produced; it is not shown in the drawing because the drawing illustrates the condition of the restored heating wall after repairs have been made and before heating is effected. The casing defines the space wherein a bridging section 213 was cast.

This bridging section is inserted as a binder or header without joints. The bridging section 213 has two heads 214 and 215 of variable width and faces 216 or 217 which are in alignment with each other. The binder head 214 and 215 have the same length. Surface 218 or the narrower binding head 215 is opposite to the surface 219 of the wider binder head 214 to project outwardly of the face of the bridging section 213.

In addition, the support surfaces 220 and 221 are provided for runner wall 202 and 204, respectively, on the bridging section 213. The support surfaces 220 or221 fit sections provided for them in the back sides 222 or 223 of the exposed headers 202 or 204 of the original masonry 1 and support it.

The form of casing is designed such that the surfaces 219 and 220 as well as surfaces 221 and 218 are formed by contact with the form or casing. The arrangement is such that the flowable mass consists of material that exhibits little or no thermal expansion during elevation to operating temperatures of the coke oven, can be poured directly onto the surfaces of the headers 202 and 204. On the other hand, the surfaces 216 and 217 and the support surfaces 224 or 225 connected with them are pared off.

The surfaces 216 and 224 and/or 217 and 225 limit the two sections 231 and 232 of an expansion joint 233 as shown in FIG. 2. The sections 231 and 232 of the expansion joint 233 are, on the other hand, limited by the connecting runners 227 and 228 of the new masonry 229. The runners 227 and 228 are made from material corresponding to the runners 202 and 204 of the original masonry. The headers 234 and 235 and the connecting runners 236 and 237 correspond to the bricks 205 and 206 and/or 203 and 205A of the original masonry 201. Because the front surfaces or faces 216 and 217 are aligned, a continuous smooth expansion joint 233 extends along each course of oven masonry. These courses are denoted in FIG. 6 by reference numerals 240–249. Also illustrated in FIG. 6 is a jointless bridging section 213 with faces 218 and 219 that are staggered from layer-to-layer which is illustrated by the binder heads 218 and 215 of variable widths. In the modification illustrated by FIG. 6, the bridging section 213 is poured or stamped in one operation to occupy the entire height of the replacement masonry by means of which the faces 216 and 217 of the binder heads 214 or 215 connect directly with each other. In the deviation of this embodiment, the bridging section 213 can, however, be subdivided horizontally and produced in sections and/or layers.

The replacement masonry 229 which is adjoined to the restored oven head after closure of the original masonry 210 by means of bridging section 213 shown in FIG. 6, is connected to the vertical expansion joint 233 and extends up the base 250 which is established with respect to size prior to the reconstruction process. The space 250 is used to compensate for vertical expansion during the subsequent heating of the replacement masonry 229. Expansion joint 233 compensates for this expansion and also an expansion of the masonry in a horizontal direction.

The replacement masonry 229 is inserted after the bridging section 213 has been cast and hardened. If the bridging section 213 is formed as sections or even in layers, the mass is allowed to harden by sections or by layers before the new masonry 229 is inserted.

Instead of pouring or stamping the bridging section 213, it can be sprayed on. In the modification of the present invention illustrated in FIG. 7, the same reference numerals have been applied to corresponding components already described and shown in regard to FIGS. 5 and 6. The modification depicted in FIG. 7 differs from that already described in regard to FIGS. 5 and 6 by the fact that the middle section of the heating wall is restored with new masonry 229 and not the oven head which is still in an original or usable condition. There are two original wall sections, one of which bears reference numerals identifying corresponding parts with the parts in the other wall section, except that the latter reference numerals carry prime suffixes. Moreover, the surfaces of the two bridging sections 213 and 213[1], used to support the runners on their back side, are shown by dot-dash hatching in order to clearly illustrate the fact that the support surfaces for the original wall sections 201 and 201[1] are comparatively larger than the support surfaces for the wall segment 229 that is to be restored.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A process for restoring a damaged part of a battery of coke ovens including the steps of exposing existing masonry for continued use as part of the coke ovens to provide support for flat connecting surfaces such that a lateral expansion joint for the replacement masonry forming a restored part of the coke ovens lies between such flat connecting surfaces and replacement masonry while said flat connecting surfaces form a continuous aligned surface for a horizontal expansion joint connecting with said lateral expansion joint and extending along between the replaced masonry and the existing masonry, selecting a replacement masonry comprising a masonry bridging material having a low thermal expansion property to provide essentially constant dimensional characteristics during heating thereof to the operating temperature of the coke ovens, and arranging said masonry bridging material to close and support said existing masonry while using surfaces on said masonry bridging material to form said flat connecting surfaces for providing said lateral expansion joint for the renewed part of the coke ovens.

2. The process according to claim 1, the improvement including the further steps of arranging said bridging brick material to extend between the ends of runner bricks forming part of existing masonry in a heating wall of the coke ovens, said bridging brick material to remain for continued use as part of the heating wall, and using side faces of the bricked-in bridging brick material facing toward said replacement masonry to establish a gap therebetween, and forming said lateral expansion joint in said gap between such side faces and the replacement masonry forming a renewed part of the heating wall.

3. The process according to claim 1 wherein said bridging brick material used to close and support said existing masonry is further defined to include bridging bricks including binder heads having broadened front surfaces, said process including the further step of closing and supporting courses of original masonary with said broadened front surfaces of the bridging bricks.

4. The process according to claim 3 including the further step of selecting bridging bricks having broad and narrow binding heads and arranging superimposed courses of the selected bridging bricks by an alternating arrangement at broad and narrow binder heads that change from course-to-course of such binding bricks.

5. The process according to claim 1 including the further step of laterally supporting said existing masonry with broadened front surfaces formed on said bridging bricks.

6. The process according to claim 5 including the further step of supporting existing masonry at the parting line between existing abutted stretcher bricks with bridging brick without said binder heads.

7. The process according to claim 5 including the further step of removing binder heads from existing masonry and closing and supporting said existing masonry with bridging bricks having said broadened front surfaces together with binder heads extending therefrom.

8. The process according to claim 1 including the further steps of supporting free ends of stretcher bricks forming part of said existing masonry with the selected bridging material at the opposed sides of an opening in a heating wall formed by removing damaged brick therefrom, arranging courses of replacement stretcher brick that undergo dimensional changes during heating to a coking temperature to bridge the opening between said bridging material while supporting said existing masonry, the replacement stretcher bricks adjoining said bridging material being spaced therefrom to define a vertical gap, and inserting material into said gap to form said lateral expansion joint.

9. The process according to claim 1 wherein the selected bridging material includes bridging bricks.

10. The process according to claim 1 wherein the selected bridging material includes flowable material for pouring into a casing.

11. The process according to claim 1 wherein the step of selecting masonry bridging material includes the steps of shaping a bridging section from castable bridging material to form a closure and support for said existing masonry, allowing the castable bridging material to harden, and thereafter using the hardened cast of bridging material to close and support said existing masonry.

12. The process according to claim 11 wherein said step of shaping a bridging section includes pouring flowable bridging material into a form.

13. The process according to claim 12 wherein said step of shaping a bridging section further includes the step of erecting said form to produce said casting at an enclosing relation with said existing masonry and thereafter introducing said flowable material into the form.

14. The process according to claim 13 wherein said step of pouring flowable bridging material includes spraying such material onto said existing masonry and said form.

15. The process according to claim 11 wherein said step of selecting masonry bridging material further includes producing a integral-hardened casting having a length selected to extend along the entire height of the opening at existing masonary in a heating wall.

16. The process according to claim 11 wherein said step of selecting masonry bridging material further includes producing a plurality of hardened castings for use as superimposed courses to extend along the entire height of the opening at existing masonry in a heating wall.

* * * * *

UNITED STATES PATENT OFFICE

CERTIFICATE OF CORRECTION

Patent No. 4,059,885 Dated November 29, 1977

Inventor(s) Hans Oldengott

It is certified that error appears in the above-identified patent and that said Letters Patent are hereby corrected as shown below:

In the claim for priority, change "application Germany May 19, 1975 2512013" to -- application Germany March 19, 1975 2512013 --.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*